US012172093B1

(12) United States Patent
Reyes

(10) Patent No.: US 12,172,093 B1
(45) Date of Patent: Dec. 24, 2024

(54) MODULAR FASTENING SYSTEM

(71) Applicant: Versari Robotics Technology LLC, Sunny Isles Beach, FL (US)

(72) Inventor: Daniel Reyes, Sunny Isles Beach, FL (US)

( * ) Notice: Subject to any disclaimer, the term of this patent is extended or adjusted under 35 U.S.C. 154(b) by 78 days.

(21) Appl. No.: 17/690,262

(22) Filed: Mar. 9, 2022

(51) Int. Cl.
*A63H 17/00* (2006.01)
*A63H 30/04* (2006.01)
*A63H 33/10* (2006.01)

(52) U.S. Cl.
CPC ..... *A63H 17/002* (2013.01); *A63H 30/04* (2013.01); *A63H 33/108* (2013.01)

(58) Field of Classification Search
CPC ..... A63H 17/002; A63H 33/108
See application file for complete search history.

(56) References Cited

U.S. PATENT DOCUMENTS 2,024,899 A * 12/1935 Westveer ..... A63H 33/108 446/122
2,320,292 A * 5/1943 Nelson ..... A63H 33/108 446/125
3,004,364 A * 10/1961 Benkelman ..... A63H 33/108 446/124
3,310,919 A * 3/1967 Bue ..... E04F 15/02 52/591.1
3,594,940 A * 7/1971 Yonezawa ..... A63H 33/04 446/96
3,603,026 A * 9/1971 Kishigami ..... A63H 33/108 446/124
4,164,091 A * 8/1979 Lin ..... A63H 33/108 446/124
4,389,809 A * 6/1983 Fischer ..... A63H 33/10 411/521
4,676,762 A * 6/1987 Ballard ..... A63H 33/105 446/124

(Continued)

FOREIGN PATENT DOCUMENTS

DE 202004011766 U1 * 11/2004 ..... A63H 11/00
GB 2336549 A * 10/1999 ..... A63H 33/042

OTHER PUBLICATIONS

Translation DE202004011766U1 (Year: 2004).*

*Primary Examiner* — Eugene L Kim
*Assistant Examiner* — Alyssa M Hylinski
(74) *Attorney, Agent, or Firm* — Sanchelima & Associates, P.A.; Jesus Sanchelima; Christian Sanchelima

(57) ABSTRACT

A modular fastening system including a board assembly, a first accessory mount assembly, a second accessory mount assembly and an interlocking assembly is disclosed herein. The board assembly includes at least one board having a plurality of openings, a peg portion and a receiving portion. The first accessory mount assembly includes a first accessory member and a first anchoring member having pegs. The first anchoring member attaches the first accessory member to the plurality of openings of the at least one board. the second accessory mount includes a second accessory member including a bottom side having at least one peg to attach said second accessory member to the plurality of openings. The peg portion of the at least one board allows to connect the at least one board with second board. The interlocking assembly includes an interlocking member to interlock at the at least one board with a second board.

9 Claims, 6 Drawing Sheets

(56) References Cited

U.S. PATENT DOCUMENTS

| | | | | | |
|---|---|---|---|---|---|
| 5,069,647 | A * | 12/1991 | Zuviria | A63H 33/08 | 446/120 |
| 5,186,672 | A * | 2/1993 | Tung | A63H 33/10 | 446/85 |
| 6,141,927 | A * | 11/2000 | Usui | E01C 9/08 | 52/263 |
| 6,581,931 | B1 | 6/2003 | Doepner et al. | | |
| 7,967,656 | B2 * | 6/2011 | Hu | A63H 33/10 | 446/124 |
| 10,058,789 | B2 * | 8/2018 | Styles | A63H 33/008 | |
| 10,518,193 | B2 * | 12/2019 | You | A63H 33/107 | |
| 10,561,958 | B2 * | 2/2020 | Purwar | A63H 33/12 | |
| 2006/0105670 | A1 * | 5/2006 | Seymour | A63H 30/04 | 446/456 |
| 2006/0264150 | A1 * | 11/2006 | Fu | A63H 31/00 | 446/465 |
| 2009/0247045 | A1 * | 10/2009 | Pettey | A63H 33/107 | 446/484 |
| 2014/0273712 | A1 * | 9/2014 | Uttley | A63H 33/102 | 446/121 |
| 2018/0214786 | A1 * | 8/2018 | Crouse | A63H 33/105 | |
| 2018/0353872 | A1 * | 12/2018 | Xia | E04H 1/1205 | |
| 2019/0091596 | A1 * | 3/2019 | Cecchin | H01R 4/48 | |
| 2019/0289716 | A1 * | 9/2019 | Bdeir | H05K 1/18 | |

* cited by examiner

MODULAR FASTENING SYSTEM

BACKGROUND OF THE INVENTION

1. Field of the Invention

The present invention relates to a modular fastening system and, more particularly, to a modular fastening system that can be fastened to an RC vehicle.

2. Description of the Related Art

Several designs for a modular fastening system have been designed in the past. None of them, however, include a modular board having a plurality of apertures to receive and secure accessory mounts.

Applicant believes that a related reference corresponds to U.S. patent No. US20060105670A1 issued for remote control electronic toy and teaching aid. Applicant believes that another related reference corresponds to U.S. Pat. No. 6,581,931B1 issued for a game board structure for construction toy set. None of these references, however, teach of a modular fastening system that includes at least one modular board having interconnecting means to interconnect with another modular board.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a modular fastening system that can be mounted to an RC vehicle.

It is another object of this invention to provide a modular fastening system that includes a plurality of apertures to receive accessory mounts.

It is still another object of the present invention to provide a modular fastening system that include interlocking means.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
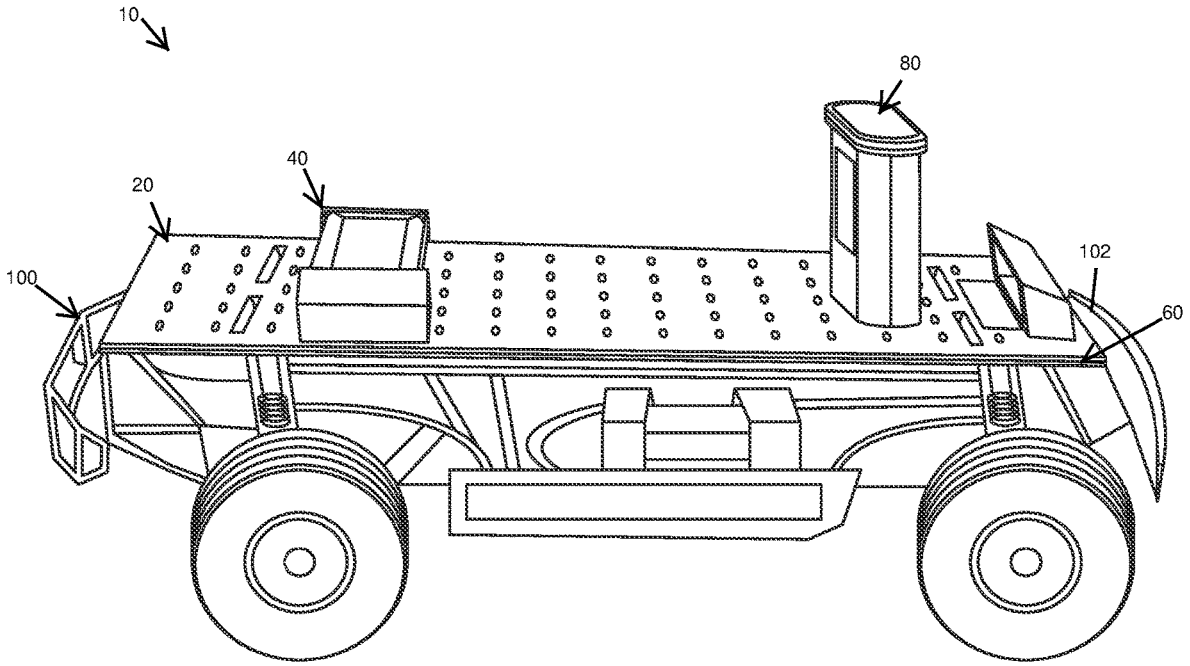
FIG. 1 represents an isometric operational view of the present invention 10. It can be observed the board assembly 20 mounted and secured to the vehicle assembly 100. The first mount assembly 40 is carrying an electric battery.

Referring now to the drawings, where the present invention is generally referred to with numeral 10, it can be observed that it basically includes a board assembly 20, a first accessory mount assembly 40, an interlocking assembly 60 a second accessory mount assembly 80 and a vehicle assembly 100. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
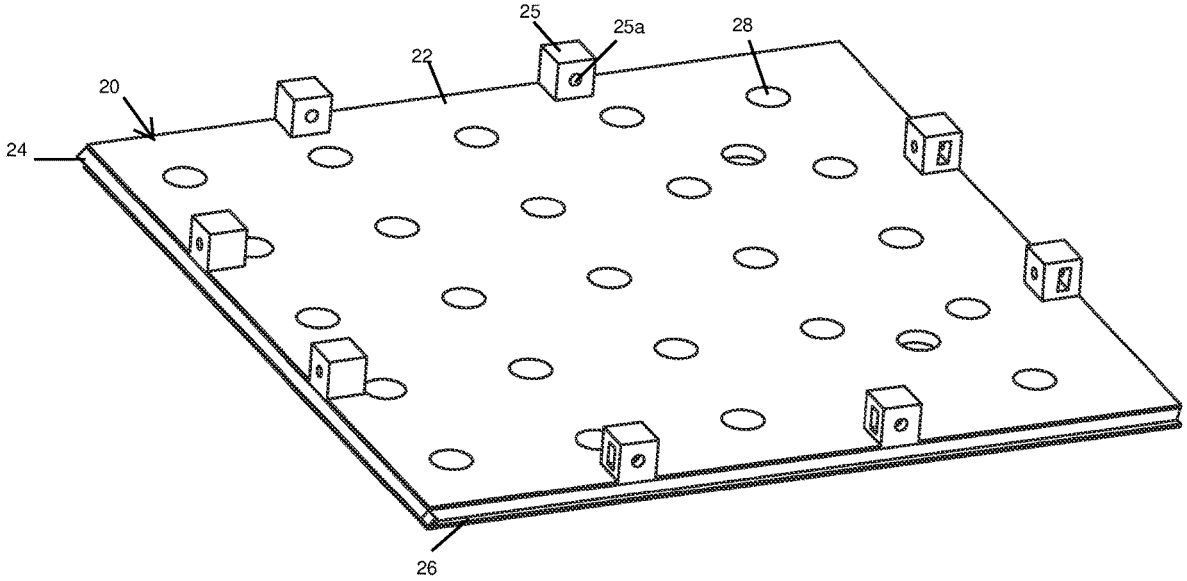
FIG. 3 illustrates an enlarged view of the board assembly 20 showing the plurality of board connectors 25.

Best observed in FIG. 3, the board assembly 20 includes at least one board 22. In one embodiment, the at least one board 22 may have a squared shape. Other embodiments of the present invention 10 may include the at least one board 22 having a circular shape, a pentagonal shape, or any other shape. The at least one board 22 may be substantially flat. The at least one board 22 may have at least a first lateral side having a peg portion 24. The peg portion 24 may be disposed along an entire length of the at least first lateral side of the at least one board 22. In one embodiment, the peg portion 24 may have a substantially protruding sharped shape. It also may be suitable to have the peg portion 24 having a flat rectangular shape, a rod shape or any other shape. It also may be suitable to form the peg portion 24 with a plurality of pegs. The at least one board 22 may also have at least a second lateral side having a receiving portion 26. The at least one receiving portion 26 may be a cut along an entire length of the at least second lateral side of the at least one board 22. In a preferred embodiment, the cut may have a triangular shape. Other embodiments may have the cut of the receiving portion 26 having any other shape suitable for receiving the peg portion 24 of at least one second board 23. The at least one second board 23 may have substantially similar to the at least one board 22. It should be understood that the peg portion 24 may have any suitable shape that fits into the receiving portion 26. It should be noted that having peg portions 24 or receiving portion 26 along at least one of the sides of the at least one board 22 may allow to connect the at least one board 22 with multiple boards. It may be suitable to connect lateral sides or front side or rear side of the at least one board 22 with another boards. It may be suitable to connect one board to each edge of the at least one board 22.

The at least one board 22 may include a plurality of apertures 28. In one embodiment, the plurality of apertures 28 may be disposed on the at least one board 22 forming a matrix along a length and a width of a top side of the at least one board 22. Other embodiments of the present invention may have the plurality of apertures 28 forming any suitable pattern. Each aperture of the plurality of apertures 28 may cross an entire depth of the at least one board 22. In one embodiment, each aperture of the plurality of apertures 28 may have a circular shape. It also may be suitable to have the plurality of apertures 28 having a squared shape, a triangular shape, an oval shape or any other shape.

The at least one board 22 may also have a plurality of board connector members 25 disposed on the top side. In a preferred embodiment, two of the plurality of board connector members 25 may be located on each edge of the top side of the at least one board 22. Each board connector member of the plurality of board connector members 25 may have a cuboid shape. It also may be suitable to have the plurality of board connector members 25 having a cylindrical shape, a prism shape or any other shape. Each board connector member of the plurality of board connector members 25 may have a first opening 25*a* across an entire width. The opening 25*a* may have a circular shape or any other shape. A lateral side of each board connector member of the plurality of board connector members 25 may have a cut having a rectangular shape or any other shape. The opening 25*a* may be aligned with a respective edge of the top side of the at least one board 22 having the two of the plurality of board connector members 25.

Figure 4:
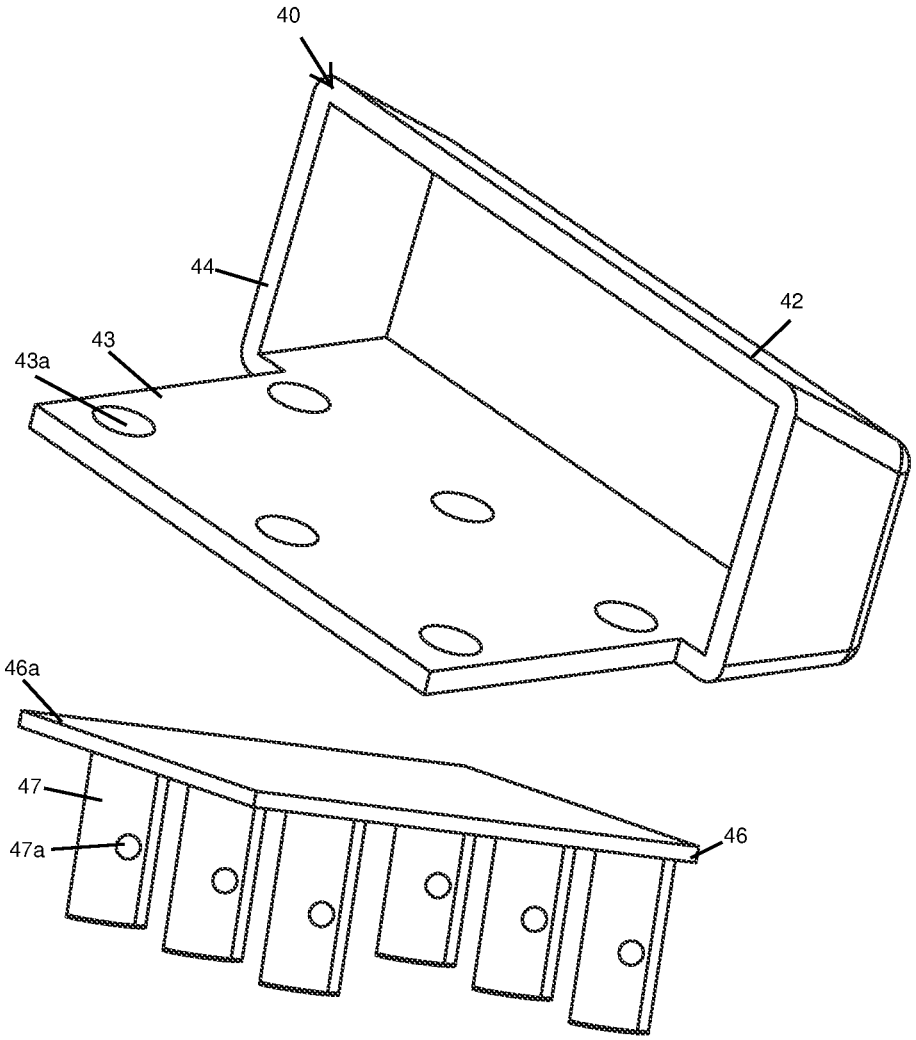
FIG. 4 is a representation of an exploded view of the first accessory mount assembly 40. It can be observed the at least one first mount member 42 and the at least one first anchoring member 46.

Referring now to FIG. 4, the first accessory mount assembly 40 includes at least one first mount member 42 and at least one first anchoring member 46. The at least one first mount member 42 may include a first base 43 having a rectangular flat shape. It also may be suitable to have the first base 43 having any other shape. The first base 43 may have a second plurality of apertures 43*a*. Each aperture of the second plurality of apertures 43*a* may have substantially same shape and same diameter than each aperture of the plurality of apertures 28. The at least one first mount member 42 may include a first holder 44 attached to one side of the first base 43. The first holder 44 may have a rear wall, a bottom wall, a right wall, a left wall and a top wall. The rear wall may have a rectangular shape with rounded edges. The bottom wall may have a substantially rectangular shape. The left wall and the right wall may have a trapezium shape. The top wall may have an inclination. The first holder 44 may have an opening opposite to the rear wall. It should be understood that the first holder 44 may be formed having any other arrangement of walls. The first holder 44 may receive an item such a sensor, a battery or the like.

The at least one anchoring member 46 may include a second base 46*a*. The second base 46*a* may have a rectangular shape. It also may be suitable to have the second base 46*a* having a circular shape, a triangular shape, a polygon shape or any other shape. The second base 46*a* may be flat. The second base 46*a* may have a second plurality of pegs 47 protruding outwardly from a rear side of the second base 46*a*. Each peg of the second plurality of pegs 47 may have a cylindrical shape. Other shapes such as a triangular shape, a rectangular shape, an oval shape or any other shape may also be suitable for each peg of the second plurality of pegs 47. Each peg of the second plurality of pegs 47 may have a peg opening 47*a* along an entire diameter. The peg opening may have a circular shape or any other shape. The second plurality of pegs 47 may be received by the second plurality of apertures 43*a*.

Figure 5:
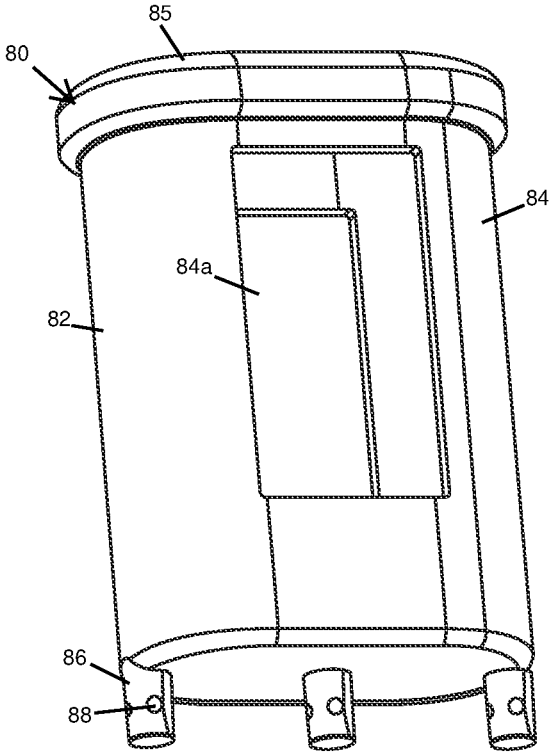
FIG. 5 is a representation of an enlarged view of the second accessory mount assembly 80.

Referring now to FIG. 5, the second accessory mount assembly 80 includes at least one second mount member 82. In one embodiment, the at least one second mount member 82 may include a second holder 84. The second holder 84 may have a substantially elliptical prism shape. It also may be suitable to have the second holder 64 having any other shape. The second holder 84 may include a second holder opening 84*a* having a rectangular shape or any other shape. The second holder opening 84*a* may allow the second holder 84 to receive a sensor, an electronical device or the like. A top portion of the second holder 84 may have a lid 85 removably attached thereon. The lid 85 may have an elliptical shape or any other shape. A bottom side of the second holder 84 may have a third plurality of pegs 86 attached thereon and disposed along a major axis. Each peg of the third plurality of pegs 86 may have a cylindrical shape or any other shape.

Figure 6:
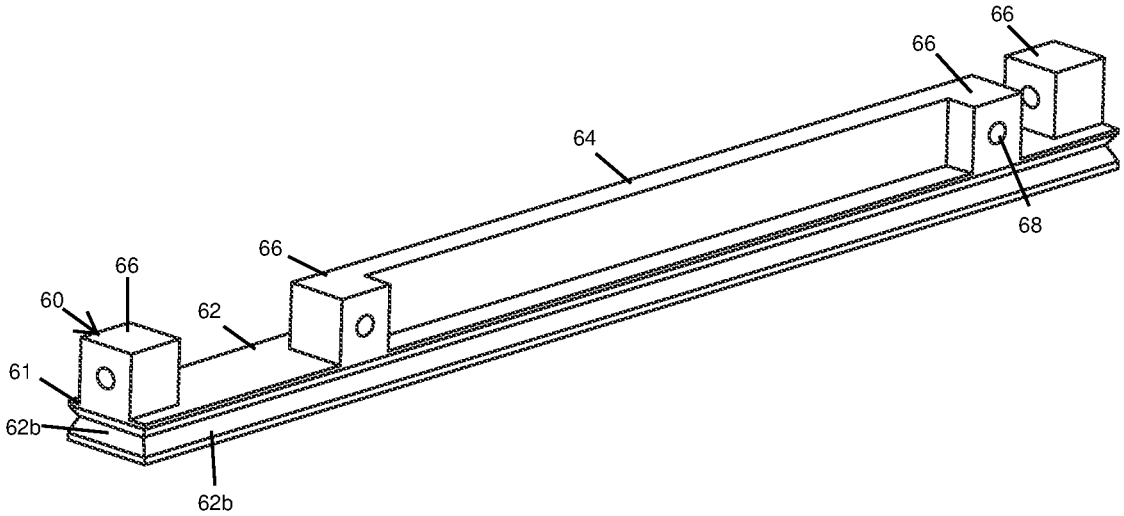
FIG. 6 is a representation of a left isometric view of the interlocking assembly 60 showing the second receiving portion 62*b*.

Referring now to FIG. 6 the interlocking assembly 60 includes an at least two interlocking members 61. Each of the at least two interlocking members 61 includes a bar element 62 a support bar 64, and plurality of interlocking connectors 66. The bar element 62 may be an elongated bar having a substantially rectangular shape. It also may be suitable to have the bar element 62 having an elongated cylindrical shape or any other shape. A first distal end and an entire lateral side of the bar element 62 may include a second receiving portion 62*b*. The second receiving portion 62*b* may be a cut along an entire length of the lateral side of the bar element 62 and a cut along the first distal end of the bar element 62. In a preferred embodiment, the cut may have a triangular shape. Other embodiments may have the cut of the second receiving portion 62*b* having any other shape suitable for receiving the peg portion 26 of the at least one board 22.

Figure 7:
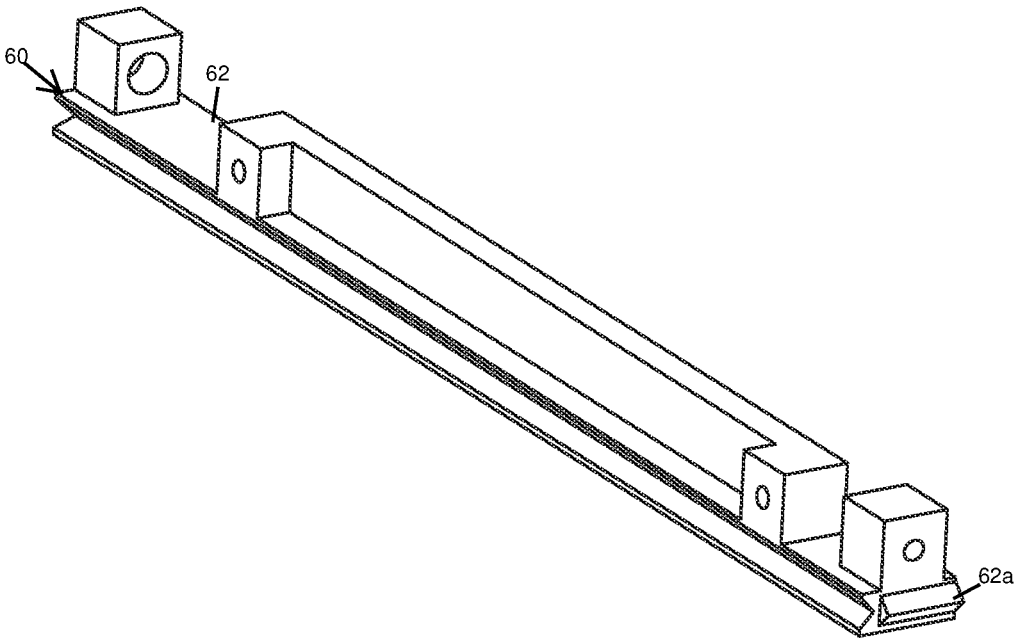
FIG. 7 is a representation right isometric view of the interlocking assembly 60 showing the second peg portion 62*a*.

Best observed in FIG. 7, the bar element 62 may have a second distal end. The second distal end of the bar element 62 may have a second peg portion 62*a* thereon. The second peg portion 62*a* may be disposed along a length of the second distal end of the bar element 62. In one embodiment, the second peg portion 62*a* may have a substantially protruding sharped shape. It also may be suitable to have the second peg portion 62*a* having a flat rectangular shape, a rod shape or any other shape. It also may be suitable to form the second peg portion 62*a* with a plurality of pegs.

Each interlocking member of the plurality of interlocking connectors 66 may have a cuboid shape or any other shape such as a cylindrical shape, a prism shape or the like. Each interlocking member of the plurality of interlocking connectors 66 may have an interlocking opening 68 along an entire width. The interlocking opening 68 may have a circular shape. It also may be suitable to have the interlocking opening 68 having a squared shape, a triangular shape, or any other shape. The plurality of interlocking connectors 66 may be attached to a top side of the bar element 62. A first interlocking connector of the plurality of interlocking connectors 66 may be located on the first distal end of the bar element 62 having the interlocking opening 68 orientated towards the length of the bar element 62. A second interlocking connector of the plurality of interlocking connectors 66 may be located on a predetermined distance from the first interlocking connector of the plurality of interlocking connectors 66. A third interlocking connector of the plurality of interlocking connectors 66 may be located on a second predetermined distance from the first interlocking connector of the plurality of interlocking connectors 66. A fourth interlocking connector of the plurality of interlocking connectors 66 may be located on the second distal end of the bar element 62. The second and third interlocking connectors of the plurality of interlocking connectors 66 may have a respective interlocking opening 68 oriented perpendicular to the interlocking opening 68 of the first interlocking connector of the plurality of interlocking connectors 66. The interlocking opening 68 of the first and fourth interlocking connectors of the plurality of interlocking connectors 66 may be aligned.

Figure 2:
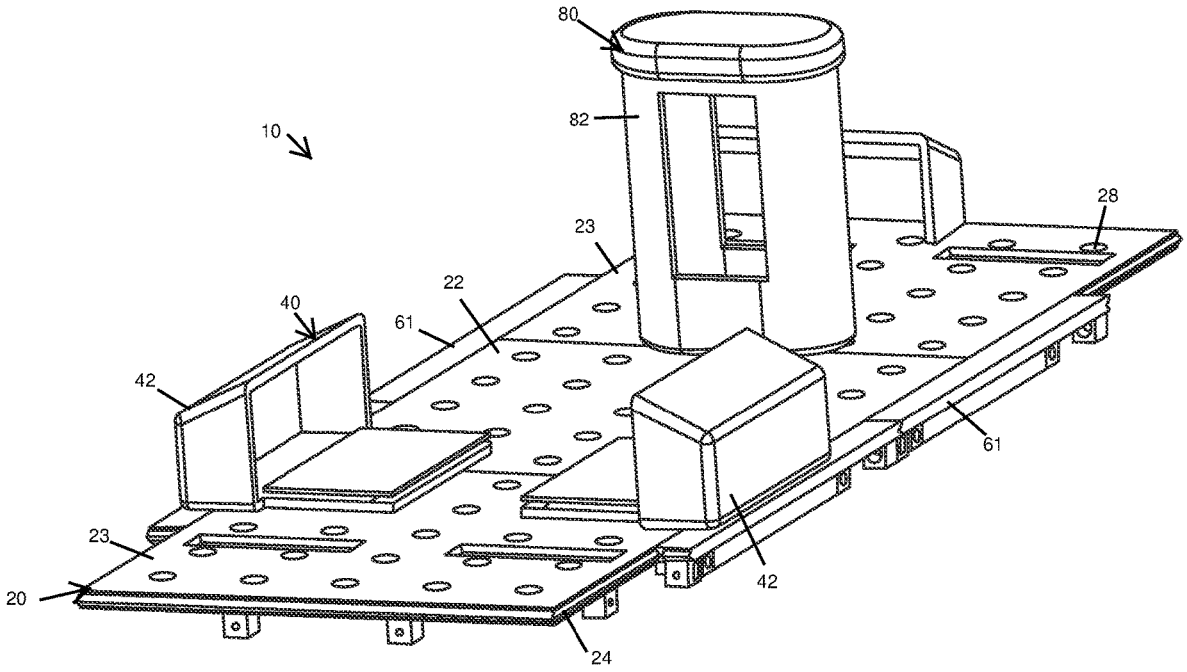
FIG. 2 shows an isometric view of the present invention 10. The first mount assembly 40 and the second mount assembly 80 are mounted to the board assembly 20. The board assembly 20 is secured via the interlocking assembly 60.
Figure 8:
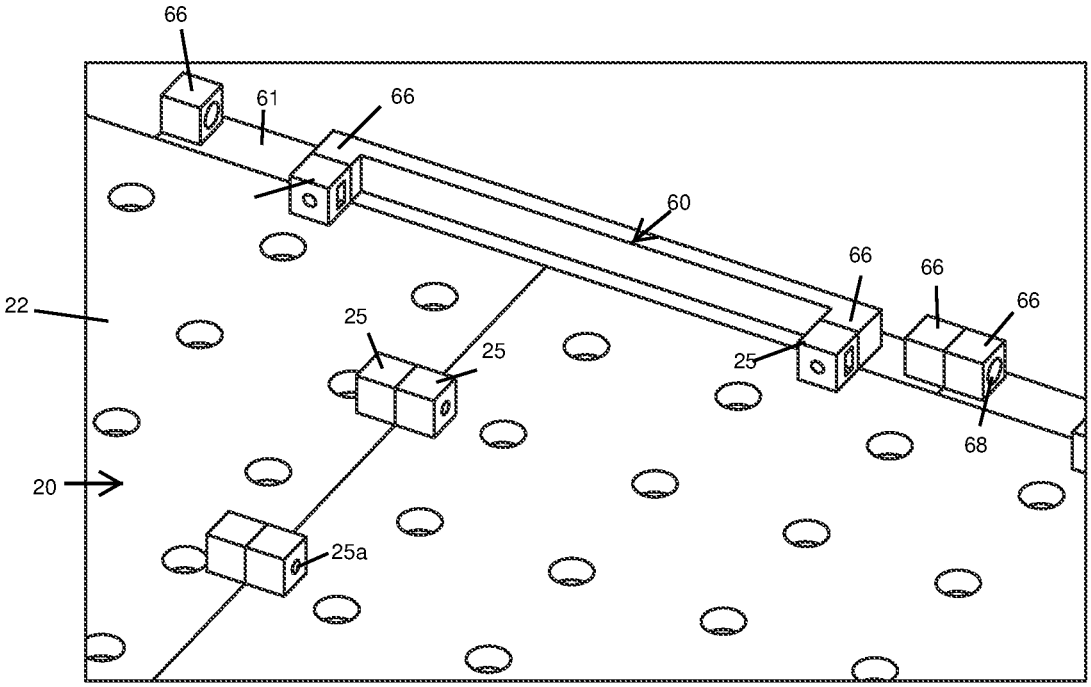
FIG. 8 is a representation of the interlocking assembly 60 interlocking the board assembly 20.

The third and fourth interlocking connectors of the plurality of interlocking connectors 66 may be connected via the support bar 64. The support bar 64 may be an elongated bar having a substantially rectangular shape. The support bar 64 may provide additional structural strength to each of the at least two interlocking member 61. Referring now to FIG. 8 and FIG. 2, it can be observed that the second receiving portion 62*b* of one of the at least two interlocking members 61 may receive the peg portion 24 of the at least one board 22 and the peg portion 24 of the at least one second board 23. The at least one board 22 may be coupled to the at least one second board 23. Two board connectors of the plurality of board connectors 25 of the at least one board 22 may cooperate with two board connectors of the plurality of board connectors 25 of the at lease one second board 23 to secure the at least one board 22 to the at least one second board 23. The first opening 25*a* of the plurality of board connectors 25 may receive fasteners to secure each of the board connectors of the plurality of board connectors 25. The second interlocking connector of the plurality of interlocking connectors 66 may cooperate with one of the board connectors of the plurality of board connectors 25 of the at least one board 22 to secure one of the at least two interlocking members 61 to the at least one board 22. The third interlocking connector of the plurality of interlocking connectors 66 may cooperate with one of the board connectors of the plurality of board connectors 25 of the at least one second board 23 to secure the one of the at least two interlocking members 61 to the at least one second board 23. The fourth interlocking connector of the plurality of interlocking connectors 66 of one of the at least two interlocking members 61 may cooperate with the first interlocking connector of the plurality of interlocking connectors 66 of a second of the at least two interlocking members 61 to secure the at least two interlocking members 61 one to each other via fasteners.

Referring now to FIG. 2, it can be observed that the at least one board 22 is coupled and secured to one of the at least one second board 23 and to another of the at least one second board 23. A first of the at least one first mount member 42 may be anchored to one of the at least one second board 23. A second of the at least one first mount member 42 may be anchored opposite to the first of the at least one first mount member. The plurality of apertures 28 may cooperate to receive the at least one first anchoring member 46. A third of the at least one first mount member 42 may be anchored to the second of the at least one second board 23. The at least one second mount member 82 may be anchored to the second of the at least one second board 23. It should be understood that the present invention 10 may have multiple boards of the at least one board 22 coupled one to each other via the at least two interlocking members 61.

Referring now to FIG. 1, the board assembly 20 may be mounted on a top side of a vehicle assembly 100. The vehicle assembly 100 may include a vehicle 102. In a preferred embodiment, the vehicle 102 may be an RC vehicle. The vehicle 102 may run up to 50 mph. It also may be suitable to mount the board assembly 20 to any other kind of vehicles. The first mount assembly 40 may carry an electronic item such a battery or a sensor. The second mount assembly 80 may also carry an electronic item. The sensor may be an ultrasonic sensor, an infrared sensor, an LiDAR sensor or any other kind of sensor.

In one embodiment, the board assembly 20, the first accessory mount assembly 40, the second accessory mount assembly 60 and the interlocking assembly 80 may be manufactured using an extruded plastic such as Acrylonitrile Styrene Acrylate (ASA), Acrylonitrile Butadiene Styrene (ABS), polyethylene terephthalate, polycarbonate, high performance polymers, polypropylene, nylon or any other plastic with high strength. It also may be suitable to manufacture the board assembly 20, the first accessory mount assembly 40, the second accessory mount assembly 60 and the interlocking assembly 80 with other strong materials such as composites, carbon fibers, aluminum, wood, or the like.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A modular fastening system, comprising:

a) a board assembly including at least first and second boards, wherein the at least first and second boards are removably attached together, wherein said at least first and second boards have a plurality of apertures, said plurality of apertures form a matrix along a length and a width of a top side of the at least first and second boards, wherein each of the boards has a first lateral side having a peg portion therealong, wherein each of the boards has a second lateral side having a receiving portion therealong, wherein each of the boards has two board connectors located on each edge of the top side and wherein two of the board connectors of an edge of the first board are aligned with two board connectors of an edge of the second board to allow openings of the aligned board connectors to receive fasteners therein for securing the first board to the second board;

b) an accessory mount assembly including at least one mount member and at least one anchoring member, said at least one anchoring member removably secures said at least one mount member to a portion of the plurality of apertures of said at least first and second boards, wherein said at least one mount member has a mount base having a plurality of mount apertures, wherein said at least one anchoring member has an anchoring base with a plurality of pegs perpendicularly protruding from a surface thereof, wherein said plurality of mount apertures are aligned with said portion of the plurality of apertures of the at least first and second boards, wherein said plurality of pegs are insertable into the plurality of mount apertures and said portion of the plurality of apertures of the at least first and second boards, said plurality of pegs have a peg hole to receive a fastener to secure the at least one mount member to one of the boards; and c) at least two interlocking members, each said interlocking member is capable of being coupled to the at least first and second boards to secure said at least first board to the second board, wherein each of the at least two interlocking members include a first distal end and an entire lateral side having a second receiving portion, said second receiving portion cooperates with the peg portion of the at least first and second boards, wherein each of the at least two interlocking members include a second distal end having a second peg portion, wherein the second peg portion of a first interlocking member of the at least two interlocking members cooperates with the second receiving portion of a second interlocking member of the at least two interlocking members to couple the at least two interlocking members one to each other, wherein the at least two interlocking members have a plurality of interlocking connectors with an interlocking opening, said interlocking connectors are removably secured to the board connectors to secure the interlocking members to the at least first and second boards.

2. The modular fastening system of claim 1, wherein said peg portion of the at least first board cooperates with the receiving portion of the second board to couple the at least first board with the second board.

3. The modular fastening system of claim 1, wherein each board of the board assembly has a rectangular shape.

4. The modular fastening system of claim 1, wherein said mount base has a rectangular shape and a first holder, said first holder is connected to said base, said first holder is configured to receive electronic items therein.

5. The modular fastening system of claim 1, wherein said at least one mount member has an elliptical prism shape having an opening to receive electronic items.

6. The modular fastening system of claim 2, wherein the peg portion has a peg triangular profile that couples with a receiver triangular profile of the receiving portion.

7. The modular fastening system of claim 4, wherein the first holder has a bottom wall, a rear wall, a right wall, a left wall and a top wall, wherein the bottom wall is attached to an edge of mount base, wherein the first holder has a front opening facing the mount base.

8. A modular fastening system, comprising:

a) a board assembly including at least first and second boards, wherein the at least first and second boards are removably attached together, wherein said at least first and second boards have a plurality of apertures, said plurality of apertures form a matrix along a length and a width of a top side of the at least first and second boards, wherein each of the boards has a first lateral side having a peg portion therealong, wherein each of the boards have a second lateral side having a receiving portion therealong, wherein the peg portion has a peg triangular profile that couples with a receiving triangular profile of the receiving portion, wherein each of the boards has two board connectors located on each edge of the top side and wherein two of the board connectors of an edge of the first board are aligned with two board connectors of an edge of the second board to allow openings of the aligned board connectors to receive fasteners therein for securing the first board to the second board, wherein said peg portion of the at least first board cooperates with the receiving portion of the second board to couple the at least first board with the second board, wherein each board of the board assembly has a rectangular shape;

b) an accessory mount assembly including at least one mount member and at least one anchoring member, said at least one anchoring member removably secures said at least one mount member to a portion of the plurality of apertures of said at least first and second boards, wherein said at least one mount member has a mount base having a plurality of mount apertures, wherein said at least one anchoring member has an anchoring base with a plurality of pegs perpendicularly protruding from a surface thereof, wherein said plurality of mount apertures are aligned with said portion of the plurality of apertures of the at least first and second boards, wherein said plurality of pegs are insertable into the plurality of mount apertures and said portion of the plurality of apertures of the at least first and second boards, said plurality of pegs have a peg hole to receive a fastener to secure the at least one mount member to one of the boards, wherein said mount base has a rectangular shape and a first holder, said first holder is connected to said base, said first holder is configured to receive electronic items therein, wherein the first holder has a bottom wall, a rear wall, a right wall, a left wall and a top wall, wherein the bottom wall is attached to an edge of mount base, wherein the first holder has a front opening facing the mount base; and c) at least two interlocking members, each said interlocking member is coupled to the at least first and second boards to secure said at least first board to the second board, wherein each of the at least two interlocking members include a first distal end and an entire lateral side having a second receiving portion, said second receiving portion cooperates with the peg portion of the at least first board, wherein each of the at least two interlocking members include a second distal end having a second peg portion, wherein the second peg portion of a first interlocking member of the at least two interlocking members cooperates with the second receiving portion of a second interlocking member of the at least two interlocking members to couple the at least two interlocking members one to each other, wherein the at least two interlocking members have a plurality of interlocking connectors with an interlocking opening, said interlocking connectors are removably secured to the board connectors to secure the interlocking members to the at least first and second boards.

9. A modular fastening system, consisting of:

a) a board assembly including at least first and second boards, wherein the at least first and second boards are removably attached together, wherein said at least first and second boards have a plurality of apertures, said plurality of apertures form a matrix along a length and a width of a top side of the at least first and second boards, wherein each of the boards has a first lateral side having a peg portion therealong, wherein each of the boards have a second lateral side having a receiving portion therealong, wherein the peg portion has a peg triangular profile that couples with a receiving triangular profile of the receiving portion, wherein each of the boards has two board connectors located on each edge of the top side and wherein two of the board connectors of an edge of the first board are aligned with two board connectors of an edge of the second board to allow openings of the aligned board connectors to receive fasteners therein for securing the first board to the second board, wherein said peg portion of the at least first board cooperates with the receiving portion of the second board to couple the at least first board with the second board, wherein each board of the board assembly has a rectangular shape;

b) an accessory mount assembly including at least one mount member and at least one anchoring member, said at least one anchoring member removably secures said at least one mount member to a portion of the plurality of apertures of said at least first and second boards, wherein said at least one mount member has a mount base having a plurality of mount apertures, wherein said at least one anchoring member has an anchoring base with a plurality of pegs perpendicularly protruding from a surface thereof, wherein said plurality of mount apertures are aligned with said portion of the plurality of apertures of the at least first and second boards, wherein said plurality of pegs are insertable into the plurality of mount apertures and said portion of the plurality of apertures of the at least first and second boards, said plurality of pegs have a peg hole to receive a fastener to secure the at least one mount member to one of the boards, wherein said mount base has a rectangular shape and a first holder, said first holder is connected to said base, said first holder is configured to receive electronic items therein, wherein the first holder has a bottom wall, a rear wall, a right wall, a left wall and a top wall, wherein the bottom wall is attached to an edge of mount base, wherein the first holder has a front opening facing the mount base; and c) at least two interlocking members, each said interlocking member is coupled to the at least first and second boards to secure said at least first board to the second board, wherein each of the at least two interlocking members include a first distal end and an entire lateral side having a second receiving portion, said second receiving portion cooperates with the peg portion of the at least first board, wherein each of the at least two interlocking members include a second distal end having a second peg portion, wherein the second peg portion of a first interlocking member of the at least two interlocking members cooperates with the second receiving portion of a second interlocking member of the at least two interlocking members to couple the at least two interlocking members one to each other, wherein the at least two interlocking members have a plurality of interlocking connectors with an interlocking opening, said interlocking connectors are removably secured to the board connectors to secure the interlocking members to the at least first and second boards.

* * * * *